United States Patent [19]

Ostrobrod

[11] Patent Number: 4,489,919

[45] Date of Patent: Dec. 25, 1984

[54] SAFETY WINCH WITH DISENGAGEABLE DRIVE

[76] Inventor: Meyer Ostrobrod, 6723 Castor Ave., Philadelphia, Pa. 19149

[21] Appl. No.: 477,347

[22] Filed: Mar. 21, 1983

[51] Int. Cl.[3] ..... B66D 1/48; B66D 1/14

[52] U.S. Cl. ..... 254/346; 254/267; 254/364; 182/232; 182/234

[58] Field of Search ..... 254/346, 357, 364, 376, 254/365, 267; 182/237, 239, 231, 232, 234; 242/84.52 C, 107.4 R, 107.4 B

[56] References Cited

U.S. PATENT DOCUMENTS

| | | | |
|---|---|---|---|
| 1,256,016 | 2/1918 | Henderson | 254/376 X |
| 2,343,884 | 3/1944 | Coffing | 254/376 X |
| 2,873,948 | 2/1959 | Colmer, Jr. et al. | 254/346 |
| 2,990,131 | 6/1961 | Carlsson | 182/237 X |
| 3,879,016 | 4/1975 | Kankkunen | 254/267 X |
| 4,130,176 | 12/1978 | Paulie | 254/357 X |

*Primary Examiner*—Stuart S. Levy
*Assistant Examiner*—Katherine Jaekel
*Attorney, Agent, or Firm*—Duffield & Lehrer

[57] ABSTRACT

A winch has a drum arranged on a rotatable shaft, a rope member connected with the drum and connectable with a load, a speed-changing transmission, a drive element arranged to drive at least one member of the transmission, and a clutch arranged to connect the shaft with the transmission to provide rotation of the drum with one speed and disconnect the shaft from the transmission to provide rotation of the drum with a different speed.

2 Claims, 7 Drawing Figures

SAFETY WINCH WITH DISENGAGEABLE DRIVE

BACKGROUND OF THE INVENTION

The present invention relates to a winch.

Winches are widely known and utilized for lifting and lowering loads. It is often necessary not only to lower and lift a load, but also to lower and lift a worker to provide worker's fall protection above ground and below ground on towers, rigs, elevators, manholes, vessels, confined entries, ladders etc. where freedom of movement is needed, to provide a temporary support for a worker when it is needed to perform work at some vertical section and lift and lower a worker after a fall has occurred. The known winches cannot be used for said work. For performing the above listed works, it is generally necessary to use several mechanisms, including winches, fall protection safety devices, fixation elements, etc. The utilization of several various mechanisms makes a person's work very inconvenient, since he must be simultaneously connected with several mechanisms. Moreover, the known winches do not have sufficiently reliable devices for protecting against a fall during lowering of a person.

SUMMARY OF THE INVENTION

Accordingly, it is an object of the present invention to provide a winch which avoids the disadvantages of the prior art.

More particularly, it is an object of the present invention to provide a winch which allows performance of a wide range of works in a fast, convenient and safe manner and at the same time does not have a complicated construction.

In keeping with these objects and with others which will become apparent hereafter, one feature of the present invention resides, briefly stated, in a winch which has a transmission arranged so that a shaft of a drum can be connected by a clutch with the transmission and rotate at one speed proportional to the rotational speed of a driving handle, and can be disconnected from the transmission so as to rotate with another speed which is determined by the speed of the rope being pulled from the drum.

In accordance with another feature of the present invention, a spiral spring is provided and arranged so that during unwinding of the rope from the drum, the spiral spring is wound in (tensioned) and during the releasing of the rope the spiral spring on account of the energy accumulated during tensioning winds the rope on back on the drum when used as a fall protection safety device.

Still another feature of the present invention is that a braking mechanism is provided which operates under the action of centrifugal force caused by fast lowering of a load, for example of an accidental fall of a worker, so as to stop free fall of worker and to absorb the energy of the stopped worker.

The novel features of the present invention which are considered as characteristic for the invention are set forth in particular in the appended claims. The invention itself, however, both as to its construction and to its manner of operation, will be best understood from the following description of a preferred embodiment which is accompanied by the following drawings.

DESCRIPTION OF A PREFERRED EMBODIMENT

Figure 1:
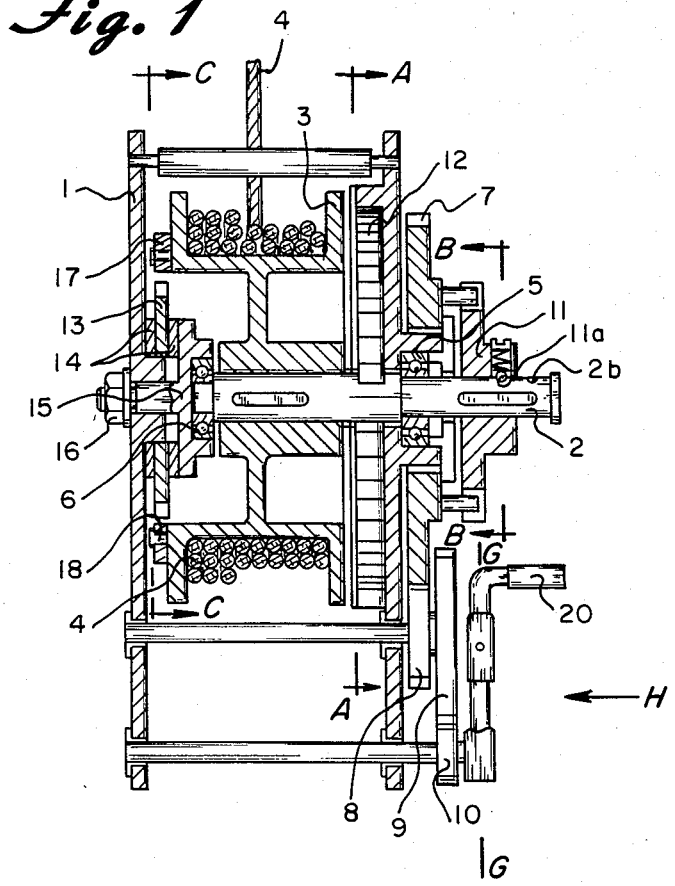
FIG. 1 is a view showing a section of a winch in accordance with the present invention.

A winch in accordance with the present invention FIG. 1 has a housing 1, a shaft 2 supported in the housing, a drum 3 mounted on the shaft 2, and a rope 4 wound on the drum 3. The shaft 2 is rotatably supported in the housing 1 via bearings 5 and 6.

The shaft 2 of the drum 3 is connected kinematically with a reducer including gears 7, 8, 9 and 10 with the aid of a clutch 11. The clutch 11 is shown in detail in FIG. 2 and serves for connecting or disconnecting the shaft 2 with the gears of the winch reducer. The clutch 11 which rotates with the shaft 2 can be manually moved between the axial position shown in FIG. 1 wherein it connects the shaft 2 to the transmission via gear 7 and the axial position shown in FIG. 2 wherein it disengages the shaft 2 from the gear 7. The clutch 11 is maintained in either of the two axial positions by interaction of the spring loaded ball 11*a* carried by the clutch with one of the sockets 2*a* or 2*b* carried by the shaft 2; the ball and sockets functioning as detents.

Figure 3:
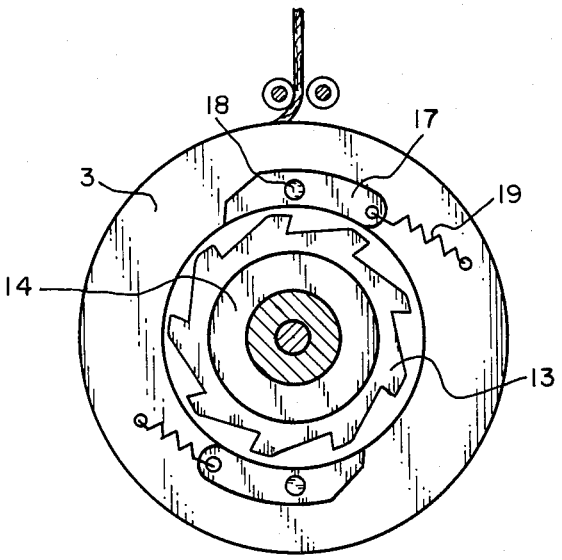
FIG. 3 is a view showing a section taken along the line C—C in FIG. 1 and illustrating pawl and a ratchet wheel of a braking mechanism.
Figure 4:
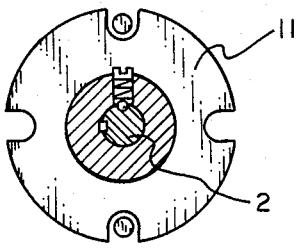
FIG. 4 is a view showing a section taken along the line B—B in FIG. 1 and illustrating the clutch formed as a pawl clutch.
Figure 5:
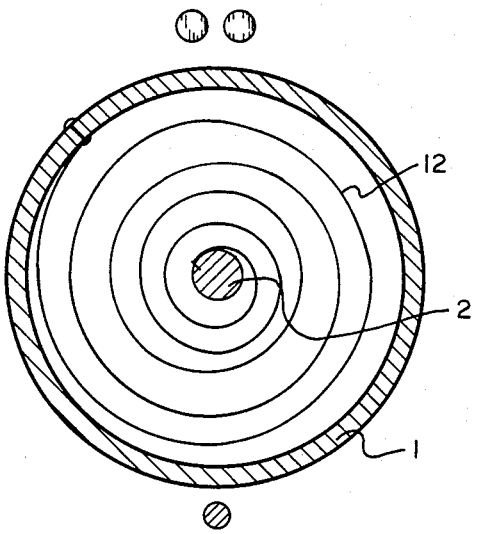
FIG. 5 is a view showing a section taken along the line A—A in FIG. 1 and illustrating a spiral spring of the inventive winch.

A spiral spring 12 shown in detail in FIG. 5 is arranged in the housing. Its one end is connected with the shaft, while its other end is connected with the housing 1 of the winch. A braking mechanism is further provided and shown in detail in FIG. 3. The braking mechanism shown in detail in FIG. 3 and FIG. 1 includes a ratchet disc 13 clamped between friction discs 14, for example with the aid of a disc of a support 15 by a nut 16. Movable members or pawls 17 are arranged on axles 18 of the drum 3 and retained by springs 19.

Figure 6:
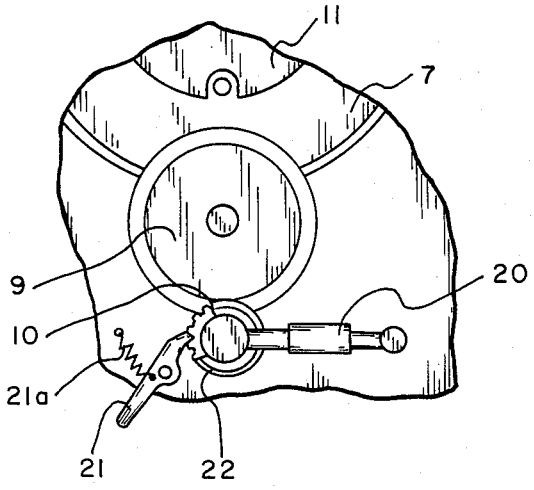
FIG. 6 is a view showing a safety member for fixation during lifting a load, taken as seen in direction of the arrow H.
Figure 7:
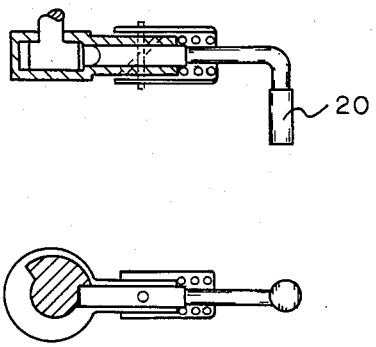
FIG. 7 is a view showing a section taken along the line G—G in FIG. 1 and illustrating a handle which can be disconnected from the shaft of the winch drum.

A handle 20 serves for driving the winch. For preventing unintentional lowering of a load during its lifting, a pawl 21 pivotally mounted to the housing 1 cooperates during load lifting with a ratchet wheel 22 which is mounted on the handle axle adjacent gear 10, as shown in FIG. 6.

The handle 20 can be permanently fixed on the shaft of the reducer. On the other hand, it can be releasable connected with the latter and become fixedly connected with the shaft only during lowering or lifting of the load.

The above described reducer can be a single-stage or a multi-stage reducer. The braking mechanism can be formed as a single-stage or a multi-stage mechanism. Its discs may be flat or conical. The clutch may be formed as a claw clutch or a friction clutch.

The above described winch in accordance with the present invention operates in the following manner:

FIG. 1 When it is necessary to lower or lift a load, such as a person, the clutch 11 kinematically connects the shaft 2 of the drum 3 with the reducer. By rotating the handle 20, the rotation is transmitted via the gears 10, 9, 8 and 7 of the reducer to the drum 3 and thereby the load connected with the rope of the drum 3 is lowered or lifted relatively slowly. The speed of rotation of the drum 3 is relatively small, and the pawls 17 assume their normal position. During lifting of the load, the safety pawl 21 biased inwardly by spring 21*a* cooperates with the ratchet wheel 22, jumps over during lifting, arrests the ratchet wheel and thereby the load in the event of stopping of rotation of the handle.

During lowering of the load, the safety pawl 21 is disengaged from the ratchet 22 by manually moving the same into an inoperative position so as to allow lowering of the load by rotation of the handle. In this position, if during lowering of the load the control of the handle is accidentally lost, the load will be falling and the speed of revolution of the drum 3 will increase considerably. As a result of the centrifugal force, the pawls 17 overcome the tensioning force of the spring 19 and turn on their axle 18 so as to engage with the ratchet disc of the braking mechanism. The rotation of the drum is stopped, and the energy of the stopped load is absorbed by the friction brake. Thus, the system of the movable members or pawls in combination with the braking mechanism provides for safety of lowering of the load. This, in turn, allows use of the inventive winch for lifting and lowering not only of industrial loads, but also of people.

Figure 2:
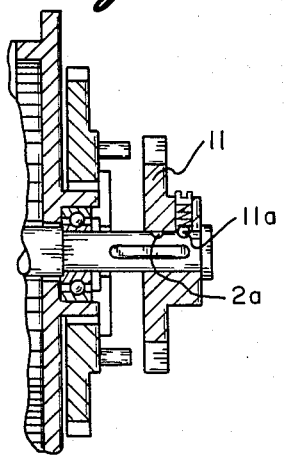
FIG. 2 is a view showing a clutch for connecting a shaft of a winch drum and disconnecting the same.

For using the winch as a safety device to protect a worker from falling when he works high, the shaft 2 of the drum 3 is disengaged from the reducer by the clutch 11, FIG. 2. The end of the rope 4 is attached to the belt of a worker. As the worker moves away from the device, the rope 4 unwinds from the drum 3 and simultaneously winds in (tensions) the spiral spring 12, FIG. 5. When the worker moves toward the device, the rope is wound onto the drum on account of the energy of the previously tensioned spiral spring 12. The rope which is attached to the worker's belt, is always under tension and "follows" the worker. In the event of an accidental fall of the worker, the rope follows the worker and rotates the drum with a high speed. The pawls 17 overcome the force of the springs 19 under the action of a centrifugal force, turn on their axles 18 and engage with the ratchet 13 of the braking mechanisms. The rotation of the drum 3 is stopped, and the energy of the stopped worker's weight is absorbed by the friction brake.

For performing rescue work, i.e. to lift or lower a worker who hangs on the rope after accidental fall, the clutch 11 is coupled and connects the shaft 2 of the drum 3 with the reducer of the winch. Then the handle is rotated and lifting or lowering of the worker is performed.

A person can be fixed when it is necessary to have an additional support. The operation is performed as described above for using the winch as a safety device whereby the person freely moves around with the rope attached to his belt. When the person must perform some work with his hands, the hands are freed in the following manner: the person jerks on the rope, and as a result of this the drum is fixed by the centrifugal brake similarly to the accidental fall of the worker to secure the person from falling. In this case, in addition to the support with the worker's legs, the worker's body obtains the fixation from the rope, so that his hands can be released.

The invention is not limited to the details shown, since various modifications and structural changes of the construction which is described as an example are possible without departing in any way from the spirit of the present invention.

What is desired to be protected by Letters Patent is set forth in the appended claims:

1. A combined winch and safety device comprising:

a housing having a drum and drum shaft rotatably mounted within said housing;

a rope adapted to be wound around said drum and having one end thereof secured to said drum, the other end of said rope being adapted to be connected to a worker;

spiral spring means connected between said drum and said housing so that during unwinding of the rope and therefore rotation of said shaft of said drum, said spiral spring means is tensioned and while during winding of the rope and therefore rotation of said shaft of said drum in an opposite direction, said spring means is relaxed;

centrifugal brake means within said housing for preventing rapid unwinding of said rope from said drum;

a speed changing transmission carried by said housing;

a manually operable drive member carried by said housing for driving at least one member of said transmission, and a clutch mounted on said drum shaft for rotation therewith and being movable between a first axial position on said shaft in which it connects said drum shaft with said transmission thereby interconnecting said drum and shaft with said drive member and a second axial position on said shaft in which the clutch disconnects said drum and shaft from said transmission so that the rotation of said drum is not affected by said drive member but is determined by the speed of the rope being wound upon or unwound from said drum and further including means for selectively maintaining said clutch in each of said first and second positions.

2. The device as claimed in claim 1, wherein said means for selectively maintaining said clutch in each of said first and second position includes detent means.

* * * * *